United States Patent [19]

Amsler

[11] 4,064,384

[45] Dec. 20, 1977

[54] ARC ELECTRODE, ESPECIALLY FOR A CONTACT ARRANGEMENT IN A VACUUM SWITCH

[75] Inventor: Joachim Amsler, Seon, Switzerland

[73] Assignee: Sprecher & Schuh AG, Aarau, Switzerland

[21] Appl. No.: 634,465

[22] Filed: Nov. 24, 1973

[30] Foreign Application Priority Data

Jan. 10, 1975 Switzerland ..... 258/75

[51] Int. Cl.[2] ..... H01H 33/66

[52] U.S. Cl. ..... 200/144 B; 200/275

[58] Field of Search ..... 200/744 B, 275, 278, 200/279

[56] References Cited

FOREIGN PATENT DOCUMENTS

| | | | |
|---|---|---|---|
| 38,299 | 6/1970 | Japan | 200/144 B |
| 460,122 | 9/1968 | Switzerland | 200/144 B |

*Primary Examiner*—Robert S. Macon

*Attorney, Agent, or Firm*—Haseltine, Lake & Waters

[57] ABSTRACT

An arc electrode, especially for a contact arrangement in a vacuum switch, comprising electrode plates serving to take-up the arc base points and secured to a contact element. Neighboring electrode plates are arranged in spaced relationship from one another. The electrode plates are provided at least at one of their surfaces with impressed or embossed recesses.

9 Claims, 4 Drawing Figures

Fig. 1
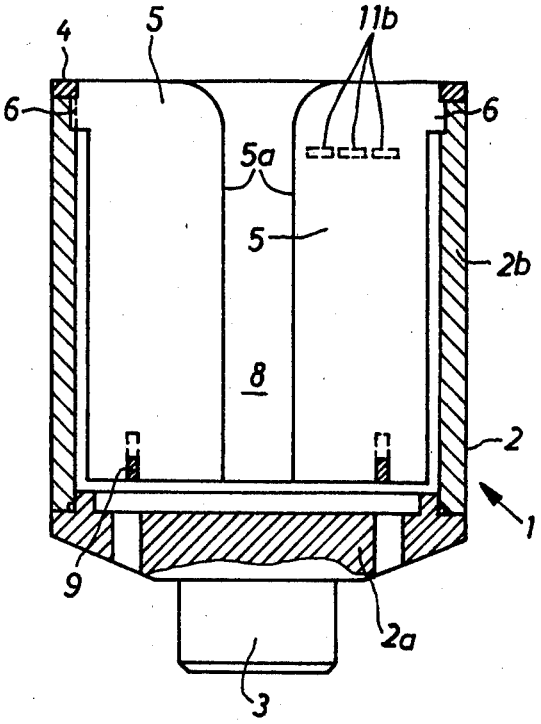
Fig. 3
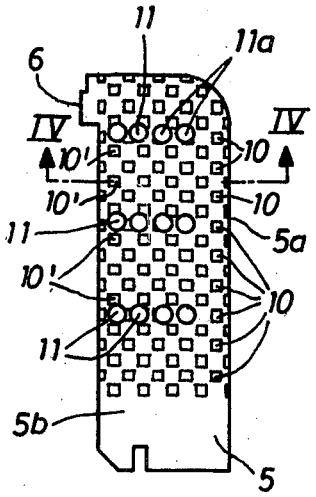
Fig. 4
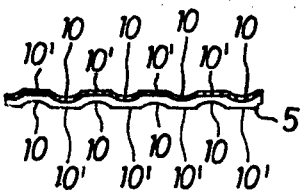
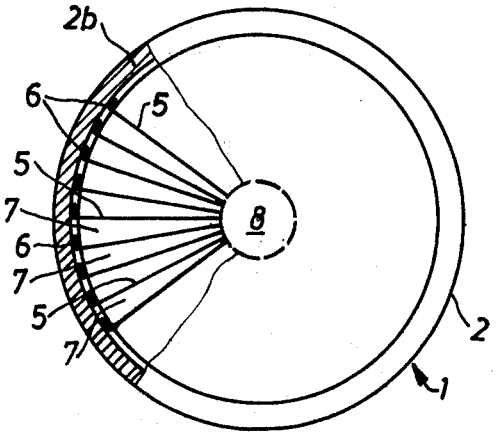
Fig. 2

ARC ELECTRODE, ESPECIALLY FOR A CONTACT ARRANGEMENT IN A VACUUM SWITCH

BACKGROUND OF THE INVENTION

The present invention relates to a new and improved construction of an arc electrode, especially for a contact arrangement in a vacuum switch, comprising electrode plates secured to a contact element and serving to take-up the arc base points, neighboring electrode plates being arranged in spaced relationship from one another.

Arc electrodes or arc electrode structures of the aforementioned type are known to the art. However, the mechanical strength of the electrode plates of such state-of-the-art arc electrodes is insufficient, so that if there are not undertaken special measures the danger exists that neighboring electrode plates will be pulled towards one another due to the traction forces brought about by the high parallel currents flowing through the plates, with the result that the mutual spacing between the plates undesirably is reduced.

In Swiss Pat. No. 531,784 there is taught to the art a construction of arc electrodes wherein, for instance, the electrode plates possess indentations which in each instance bear against the immediately neighboring electrode plate in order to insure for the requisite spacing between neighboring electrode plates. By means of these indentations the neighboring plates are in contact with one another, but this however should be avoided.

SUMMARY OF THE INVENTION

Hence, it is a primary object of the present invention to provide a new and improved construction of an arc electrode, especially for a contact arrangement in a vacuum switch, which is not associated with the aforementioned drawbacks and limitations of the prior art proposals.

Another important and more specific object of this invention aims at the provision of an arc electrode of the previously mentioned type wherein the electrode plates thereof possess satisfactory mechanical strength, and which can be fabricated in an economical manner and permits cutting-off of as high as possible currents.

Now in order to implement these and still further objects of the invention, which will become more readily apparent as the description proceeds, the invention contemplates providing the electrode plates at least at one of their surfaces with impressed recesses.

BRIEF DESCRIPTION OF THE DRAWING

The invention will be better understood, and objects other than those set forth above, will become apparent when consideration is given to the following detailed description thereof. Such description makes reference to the annexed drawing wherein:

FIG. 1 is a cross-sectional view of an arc electrode constructed in accordance with the teachings of the present invention;

FIG. 2 is a top plan view of the arc electrode structure of FIG. 1;

FIG. 3 is a side view of an electrode plate or plate member; and

FIG. 4 is a cross-sectional view taken along the line IV—IV of FIG. 3.

DETAILED DESCRIPTION OF THE PREFERRED EMBODIMENTS

Describing now the drawing, it is to be understood that only enough of the structure of the vacuum switch with which, for instance, the arc electrode or arc electrode structure of this development can be used, will be discussed in order to enable those skilled in the art to readily understand the underlying concepts of this development and to simplify the illustration. Turning attention therefore to FIGS. 1 and 2, there is illustrated therein an arc electrode which in conjunction with an identical or similar second arc electrode forms in conventional manner a contact arrangement for a vacuum switch. This arc electrode 1 possesses a substantially hollow cylindrical contact piece or element 2 formed of suitable electrically conductive material. The contact element 2 comprises a base or floor portion **2*a* and a wall portion 2*b*. The illustrated arc electrode 1 is constructed as the stationary electrode of the contact arrangement and possesses a bolt or pin 3 or equivalent structure secured to the base portion 2*a* and which serves for the attachment of the contact element 2** at *a* not particularly illustrated housing of the vacuum switch.

The wall portion **2*b* forms at its free end a substantially ring-shaped contact surface 4 which, in the closed condition or state of the contact arrangement, is in contact with the corresponding or associated contact surface of the not particularly illustrated second arc electrode. At the inside or inner surface of the wall portion 2*b* there are arranged radially extending electrode plates or plate members 5, for instance formed of sheet metal, these plates 5 being electrically conductively connected with the wall portion 2*b***.

The electrode plates 5 are provided with a flexed tongue or tab 6 or equivalent structure, by means of which the plate members or plates 5 are secured at the wall portion **2*b*, for instance by hard soldering. As best seen by referring to FIG. 2, a gap or space 7 is formed between neighboring electrode plates 5. The narrow surfaces 5*a* of each of the electrode plates 5 initially extend essentially parallel to the plane of the contact surfaces 4 and then extend in the direction of the base or floor portion 2*a*. These narrow surfaces 5*a* define a space or chamber 8** for the arc which is formed upon opening the vacuum switch.

The electrode plates 5 are connected with one another at their respective lower end by means of a centering ring or ring member 9 or equivalent structure.

Continuing, on the basis of the showing of FIGS. 3 and 4 there will now be considered in detail the construction of the electrode plates 5 which have only been schematically shown in FIGS. 1 and 2. Since the individual plates may be advantageously of the same construction it will suffice to describe in detail the construction of one such plate.

Each electrode plate or plate member 5 is provided at both sides or faces **5*b* with impressed or embossed recesses 10 which at the opposite face or side of the same plate 5 appear in the form of raised portions or protuberances 10'. The recesses 10 are impressed or embossed so as to be arranged in lines and columns as best seen by referring to FIGS. 3 and 4. Further, it will be seen that the recesses 10 at one side or face 5*b* of a given plate or plate member 5 are arranged in offset relationship with regard to the recesses 10 appearing at the opposite side or face of such plate member. By means of these impressions or embossments which form the recesses 10 the electrode plates 5** are reinforced, so that there are not required any additional supports or bracing between the electrode plates.

Moreover, the electrode plates 5 are provided with throughpassageways or openings 11, which in the exemplary embodiment under discussion are constituted by substantially round or circular holes 11*a* arranged adjacent one another. However, it is to be of course understood that such throughpassageways or openings 11 could possess a different shape or configuration.

With the exemplary embodiment of electrode plate or plate member 5 illustrated in FIG. 3 there are provided three rows of holes 11*a* distributed over the height of the plate member. Further, the holes 11*a* or the like of each row are essentially distributably arranged over the entire width of the plate member or plate 5. However, in order to realize the stated objectives it is also possible to provide throughpassageways or openings 11 only at the region of the narrow side 5*a* of the plate members or plates 5.

Upon opening a vacuum switch which is equipped with a stationary arc electrode and a movable arc electrode, each of the aforementioned disclosed type, an arc is formed between the contact surfaces 4 of both contact elements 2, which arc, under the action of the self-magnetic field, commutates to the narrow surfaces 5*a* of the electrode plates 5 where it burns in a diffuse manner until it is extinguished. The hot metallic vapors flowing through the gaps or spaces 7 between the electrode plates are cooled and condensed at the surfaces 5*b* of electrode plates 5 so that such gases cannot arrive at the separation or disconnection path. Now since these surfaces 5*b* of the electrode plates 5 are enlarged or increased in surface area due to the impressed or embossed recesses 10, there is realized an improved condensation of the aforementioned metallic vapors and an improvement in the extinguishing characteristics because a larger surface or area is available for the arc plasma column.

The throughpassageways or openings 11 in the electrode plates 5 augment stabilization of the arc. By means of these throughpassageways 11 the current flowing through the electrode plates 5 is forced to flow at the region of the narrow surfaces 5*a* of such electrode plates, i.e. at the region of the base points of the arc, resulting in a beneficial intensification of the magnetic field acting upon the arc. Additionally, the voltage drop along the current-carrying electrode plates brings about that the arc can easily jump over to the axially oppositely situated plate where there is not present any such voltage or potential drop. Consequently, the arc is confined in the central space or chamber 8 of the arc electrode.

Since all of the electrode plates 5 are impressed or embossed in the same manner, it is possible in each instance for neighboring plates to be arranged such that in each case the raised portions or protuberances 10' of one plate 5 engage with the recesses 10 of the neighboring plate 5 without such electrode plates contacting one another. In this way there is prevented the presence of a linear passageway or passage through the gap 7 which is present between mutually neighboring electrode plates 5. What is of importance, however, and as already mentioned, is that the neighboring electrode plates do not contact one another and that the gaps or spaces 7 permit gas flow.

The arc, which as mentioned is formed upon separation of the arc electrodes 1, brings about that the metal which is melted at the arc base points is propelled away in the form of droplets. In the case of the prior art electrode plates possessing a smooth surface the metallic droplets impinging at the plates are so-to-speak "rubbed" or "smeared" at the plate surfaces without adhering thereto. After solidification the metal drops-off in the form of small needle-shaped metallic particles which can arrive at the separation path, which can lead to undesired reignition.

Since, with the described exemplary embodiment, the electrode plates do not possess any smooth surfaces due to the provision of the impressed or embossed recesses 10, the metallic droplets practically always impact against the surfaces bounding the recesses 10 and extending transversely with respect to the path of flight of the metallic droplets and at which surfaces the latter remain adhering. In this way there is avoided that the aforementioned metallic droplets will reach the separation path.

Prior to assembly of the electrode plates they must be degased. It has been found that the surface which is enlarged in size due to the impressed recesses provides for improved degasification of the plates.

In FIG. 3 the recesses 10 have been illustrated by way of example to possess an essentially quadratic or square configuration. However, it is to be understood that the shape or form of such recesses 10 is optional. What is only of importance is that by virtue of the impression or embossment the surface is enlarged in size or surface area in relation to a flat or planar electrode plate, for instance by about 40%, and that there is obtained the desired mechanical strength.

Further, it is mentioned that instead of the throughpassageways or openings 11 possessing substantially circular holes 11*a*, there can be provided throughpassageways constituted by slots or slits, as indicated in phantom lines by reference character 11*b* in FIG. 1.

Finally, it is mentioned that it is also conceivable to construct the contact element 2 differently than shown. For instance, it is possible, as disclosed in Swiss Pat. No. 531,784, the disclosure of which is incorporated herein by reference, to construct the contact element from two oppositely situated, upright arranged, substantially U-shaped members between which there are located substantially parallelly arranged electrode plates of the previously described types.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. An arc electrode particularly for a contact arrangement in a vacuum switch, comprising a contact element having a contact surface; electrode plates having arcing surfaces for taking-up the arc base points; means for securing the electrode plates at said contact element, said electrode plates being arranged in spaced relationship from one another by a separation gap and extending away from said contact surface, each electrode plate having opposite faces, each electrode plate having impressed recesses at least at one face of said electrode plate, said recesses being in an area outside said separation gap free of electrical stress.

2. The arc electrode as defined in claim 1, wherein said electrode plates have recesses at both faces thereof, said recesses being arranged in columns and lines, said contact element having a substantially hollow cylindrical construction, said electrode plates extending substantially in radial direction within the interior of said contact element, each of said electrode plates including a narrow surface, said electrode plates being arranged in a substantially circular configuration within said contact element so that predetermined ones of said electrode plates are situated with their respective narrow surfaces in spaced confronting relationship from one another to define free narrow surfaces, said electrode plates having means defining through-passageways at least at the region of their free narrow surfaces, said through-passageways comprising an arrangement of a number of rows of said through-passageways extending in spaced relationship from one another, each row containing a number of through-passageways adjacently arranged and distributed over the width of the associated electrode plate, said through-passageways comprising substantially circular holes.

3. The arc electrode as defined in claim 1, wherein the electrode plates are provided with recesses at both faces thereof.

4. The arc electrode as defined in claim 2, wherein the recesses are arranged in columns and lines.

5. The arc electrode as defined in claim 2, wherein said contact element possesses a substantially hollow cylindrical construction, said electrode plates extending substantially in radial direction within the interior of said contact element.

6. The arc electrode as defined in claim 4, wherein each of the electrode plates include a narrow surface, said electrode plates being arranged in a substantially circular configuration within said contact element such that given ones of said electrode plates are situated with their respective narrow surfaces in spaced confronting relationship from one another to define free narrow surfaces, and the electrode plates are provided at least at the region of their free narrow surfaces with means defining throughpassageways.

7. The arc electrode as defined in claim 5, wherein the throughpassageways comprise an arrangement of a number of rows of such throughpassageways extending in spaced relationship from one another, each row containing a number of throughpassageways which are adjacently arranged and distributed over the width of the associated electrode plate.

8. The arc electrode as defined in claim 5, wherein said throughpassageways comprise essentially circular holes.

9. The arc electrode as defined in claim 5, wherein the throughpassageways comprise slot means.

* * * * *